US006592084B1

(12) United States Patent
Nile

(10) Patent No.: US 6,592,084 B1
(45) Date of Patent: Jul. 15, 2003

(54) RESILIENT FLEXIBLE TRACKING BABY BOTTLE FEEDER

(76) Inventor: Lance A. Nile, 385 Millbrook Ave., Randolph, NJ (US) 07869-2109

( * ) Notice: Subject to any disclaimer, the term of this patent is extended or adjusted under 35 U.S.C. 154(b) by 35 days.

(21) Appl. No.: 10/193,430

(22) Filed: Jul. 11, 2002

(51) Int. Cl.[7] ..... A47D 15/00; A61J 9/06

(52) U.S. Cl. ..... 248/104; 248/102; 248/105; 248/106

(58) Field of Search ..... 248/104, 102, 248/105, 106; 5/639, 636, 640, 655

(56) References Cited

U.S. PATENT DOCUMENTS

| | | | | | |
|---|---|---|---|---|---|
| 712,184 | A | | 10/1902 | Feld | |
| 1,385,085 | A | * | 7/1921 | Mahoney | 248/104 |
| 1,559,740 | A | | 11/1925 | Cardarella | |
| 1,778,545 | A | * | 8/1930 | Allen | 248/102 |
| 2,344,255 | A | * | 3/1944 | Lichter | 248/106 |
| 2,399,320 | A | * | 4/1946 | Brose | 248/104 |
| 2,462,187 | A | | 2/1949 | Helixon | 248/104 |
| 2,490,207 | A | | 12/1949 | Cassile | 248/102 |
| 2,510,953 | A | * | 6/1950 | Brose | 248/102 |
| 2,518,862 | A | * | 8/1950 | Cain | 248/104 |
| 2,522,647 | A | * | 9/1950 | Suich | 248/105 |
| 2,545,414 | A | | 3/1951 | Pittman | 248/104 |
| 2,637,515 | A | | 5/1953 | Walsh | 248/102 |
| 2,830,781 | A | | 4/1958 | Coulter | 248/103 |
| 2,991,032 | A | | 7/1961 | Theis | 248/102 |
| 3,028,133 | A | | 4/1962 | Craig | 248/106 |
| 3,184,193 | A | | 5/1965 | Melvin | 248/106 |
| 3,298,649 | A | | 1/1967 | Paglee | 248/103 |
| 3,425,653 | A | * | 2/1969 | Rauch | 248/104 |
| 4,014,505 | A | | 3/1977 | Dowd | 248/102 |
| 4,062,510 | A | | 12/1977 | Brochu | 248/102 |
| 4,301,934 | A | | 11/1981 | Forestal | 215/11 D |
| 4,309,008 | A | | 1/1982 | Sirks | 248/105 |
| 4,630,793 | A | | 12/1986 | Hunter | 248/102 |
| 4,726,551 | A | * | 2/1988 | Randall et al. | 248/102 |
| 4,895,327 | A | * | 1/1990 | Malone et al. | 248/102 |
| 4,944,418 | A | | 7/1990 | Wallace | 215/100 R |
| 4,953,816 | A | | 9/1990 | Wilkinson | 248/102 |

(List continued on next page.)

*Primary Examiner*—Leslie A. Braun
*Assistant Examiner*—Amy J. Sterling
(74) *Attorney, Agent, or Firm*—Ernest D. Buff & Associates, LLC; Ernest D. Buff; Dove Narovimhan

(57) ABSTRACT

A detachable flexible baby bottle holder controls displacement of the bottle during feeding. The bottle is held within a cavity by a flexible, soft, elastomeric element, which is secured against the infant's chest using plurality of adjustable straps. Tensile forces exerted by the straps on the elastomeric, soft, flexible bottle holder create an elliptically shaped cavity in which the bottle resides. Movement of the bottle within the elliptically shaped cavity tracks movement of the infant, providing controlled displacement of said bottle in directions corresponding thereto. Bottle motion is accommodated during feeding within a range of several centimeters, minimizing application of transverse and vertical forces otherwise exerted by the nipple. Compliance required for the baby bottle holding system is achieved by the cooperative combination of the elliptical cavity, the flexibility and softness of the trapezoidal element and the tension imposed by the adjustable straps. The compliance and holding are such that bottle tracking is facilitated in each of the lateral and vertical directions, so control between the infant's mouth and the nipple is maintained. Such "tracking action" advantageously enables the bottle to be available for nursing at all times without applying excessive pressure against the infant's mouth. Importantly, the infant can stop nursing at any time, without having to reject the nipple. Liquid contained by the bottle is not spilled, since the collapsed plastic element therein promotes retention of the liquid unless the infant is nursing. The bottle remains constantly within reach of the infant, and is readily rejected and re-accessed, without consequent spillage of its liquid contents.

9 Claims, 4 Drawing Sheets

U.S. PATENT DOCUMENTS 5,022,616 A * 6/1991 Kordecki ..... 248/106
5,037,046 A 8/1991 Mingledorff, Jr. ..... 248/106
5,092,549 A 3/1992 Beech ..... 248/103
5,129,610 A 7/1992 Campbell ..... 248/106
5,135,189 A 8/1992 Ghazizadeh ..... 248/104
5,184,796 A * 2/1993 Maher ..... 248/104
5,456,432 A * 10/1995 Ennis et al. ..... 248/102
5,489,075 A 2/1996 Ible ..... 248/104
5,603,479 A 2/1997 Kristy ..... 248/548
5,727,842 A 3/1998 O'Neil ..... 297/188.06
5,823,486 A 10/1998 Smith et al. ..... 248/104
5,927,661 A 7/1999 Tinsley et al. ..... 248/102
5,979,843 A 11/1999 Beck ..... 248/102
6,055,667 A * 5/2000 Jimenez ..... 2/49.1
6,082,681 A * 7/2000 Rand ..... 248/102
6,098,934 A * 8/2000 Skelton ..... 248/102
6,213,547 B1 4/2001 Bowe et al. ..... 297/188.01
6,253,936 B1 * 7/2001 Kong ..... 215/11.3
6,473,923 B1 * 11/2002 Straub ..... 5/655

* cited by examiner

RESILIENT FLEXIBLE TRACKING BABY BOTTLE FEEDER

BACKGROUND OF THE INVENTION

1. Field of the Invention

The present invention relates to bottle feeding of infants; and more particularly, to a bottle supporting unit having a soft, compliant holding structure that retains the bottle in position, so that its nipple end remains proximate the mouth of the infant, without applying excessive pressure against the infant's mouth during feeding.

2. Description of the Prior Art

There has long existed a clear recognition by the art concerning the need for infant feeding without active parental monitoring. Numerous bottle-holding mechanisms have been devised, which attempt to hold a feeding bottle in a feeding position during residence of the infant in a car seat, crib, couch, or bed.

U.S. Pat. No. 0,712,184 to Feld, discloses a nursing bottle holder for baby carriages. The nursing bottle is attached to a baby carriage using an elliptical or loop shaped wire frame, which receives and holds the nursing bottle. The position of the nursing bottle can be adjusted in a vertical plane by sliding the attachment on a vertical wire frame. Connection to the carriage is achieved using a rigid attachment. A nursing bottle within the holder would not readily track an infant's movement, and could not accommodate the motion of an infant without applying undue pressure against the infant's mouth. Moreover, the holder provides no means for presentation of the bottle at an angle that assures free flow of its liquid content.

U.S. Pat. 1,559,740 to Cardarella discloses a nursing bottle holder that is attached to he frame of a crib using an elastic retaining member. The bottle is looped into the elastic ember. It is prevented from tipping by a retaining system, which is disposed substantially perpendicular to the elastic band. To position the bottle, the elastic strap, as well as the bottle holding strap must be adjusted individually to meet the feeding needs of each infant. When the supporting elastic is drawn tightly, the bottle is released if the infant lets go of the nipple. The bottle is attached to an external frame, and is aimed at an infant to position the nipple in close proximity with the baby's face. Inasmuch as the elastic is under tension during use of the device, the bottle must be positioned within a critical distance from the baby's face. Excessive pressure is otherwise applied against the infant's mouth. Slight displacement of the infant alters the feeding angle, placing significant load on the nipple.

U.S. Pat. No. 2,462,187 to Helixon discloses a nursing bottle holder, which is suspended from an infant crib or carriage using tapes. The nursing bottle is held in a pocket composed of flexible material. The pocket is constructed from one half of a hexagon material blank, which is folded and stitched to form the pocket. The pocket is attached to tapes, which loop around the railing of a carriage or infant crib bed frame. These tapes suspend the pocket, which carries the nursing bottle at a required location. Due to this attachment, the nursing bottle is not secured to the infant. Movement of the infant causes the bottle to become inaccessible. In addition, slight movement of the infant causes the bottle to apply large pressures against the infant's mouth. Further, the bottle-retaining device does not address issues such as accessibility and angular location of the bottle during feeding.

U.S. Pat. No. 2,490,207 to Cassile discloses a nursing bottle holder, which is supported by adjustable flexible straps. The flexible straps are attached to the frame of an infant's crib, and the bottle is positioned within reaching distance of the baby. The inclination of the bottle with respect to the baby is not adjustable. Once attached to a crib, the distance between bottle and infant remains fixed. No mechanism is provided for adjusting the location of the bottle with respect to the baby to compensate for movement of the baby within the crib.

U.S. Pat. No. 2,545,414 to Pittman, discloses a baby feeder bottle. The bottle is attached to a crib frame so that the angle of the bottle, relative to the baby, can be adjusted by adjusting the length of retaining straps. Rotating a T shaped fixture around a fixed point, at which the bottle and crib are attached, changes bottle location within the crib. Pittman's mechanism provides a fixed bottle location, which cannot be adjusted as the baby moves within the crib. The angle of bottle inclination is preset at the time of attachment. If a baby turns his head during feeding, the bottle inclination is maintained, causing the feeder bottle to drip. No compensation is provided for movement of the baby's head to a position not aligned with the feeder bottle; in such circumstances the bottle becomes inaccessible.

U.S. Pat. No. 2,637,515 to Walsh discloses a holder for an infants' nursing bottle. The bottle is attached to a crib using two elastomeric straps. Bottle angle is fixed by orientation of a receptacle, which holds the bottle. The attachment means also operates to locate the bottle in a fixed position within the crib. An infant must be positioned within the crib with its mouth 'aimed' at the end of the nursing bottle. Movement of the infant tends to cause bottle inaccessibility, since no means are provided for movement of the bottle head in a lateral or vertical direction. If the infant moves slightly during nursing the elastomeric straps tend to apply undue pressure against a side of the baby's mouth. Due to the receptacle design, the angle of the bottle is preset. Flow rate of the bottle's liquid contents is altered by changes of liquid level therewithin. Such uneven liquid flow rate adversely affects feeding requirements, preventing constant liquid flow upon demand.

U.S. Pat. No. 2,830,781 to Coulters discloses a nursing bottle holder attached to vertical rungs of a crib. Two adjacent posts are utilized to clamp a swingable arm, which angles the bottle so that the liquid may be delivered. During use, the baby must turn to one side to face the nursing bottle. The position of the bottle during nursing is prearranged with care so that the end of the bottle reaches the baby's mouth. A swinging action enables bottle movement solely in a horizontal plane; no accommodation is provided for tilting of the baby's head. Slight motion of the baby causes loss of contact with the nursing bottle. Tilting of the bottle tends to result in liquid seepage therefrom. If the baby tries to hold on to the bottle, excessive pressure is applied against the baby's mouth. The bottle does not "track" movement of the baby in a vertical or lateral direction, and would likely not be useful in a vehicle or other situation where vertical and lateral motion of the baby is present.

U.S. Pat. No. 2,991,032 to Theis discloses a baby bottle holder attached to vertical rungs of a crib on either side, using four rope elements. These rope elements are attached to a baby bottle holder, which comprises an endless tubular flexible band, formed from rubber or rubber like material. The position of the bottle and its angle are determined solely by the locations of the straps on the vertical rungs. The patent discloses a nursing bottle holding device, which is clamped in flexible bands and is adjusted by four support elements attached to the vertical rungs of a baby crib. Location and angle of the nursing bottle are solely determined by the location of these four attachments. Thus, the location of the bottle is fixed in space. The baby has to be located at that exact location, and slight motion of the baby causes application of excessive pressure on the baby's mouth, or loss of feeding function. The bottle, which is inclined, may leak, causing spillage of liquid contained therein. In addition, the bottle does not "track" movement of the baby in lateral and vertical directions, and therefore cannot be readily used in a vehicle or like situation where motion of the baby is present.

U.S. Pat. No. 3,028,133 to Craig discloses a baby bottle holding device for use on a flat surface. The surface is attached to a tiltable beam, which rests on a frame placed on the flat surface. A counter weight is used to counterbalance the bottle's weight with liquid contents therein. The bottle is aimed in the direction of the baby by adjustably positioning supports resting on the flat surface. The tilt beam is inclined to access the bottle. An angular inclination of the bottle is automatically available since the beam is tilted down. When the nursing operation is complete, the beam tilts upwards, raising the bottle, to prevent the spill of the liquid contained therein. The patent discloses a nursing bottle holding device, which rests on a flat surface so that the bottle is attached to a balanced beam. An end of the bottle is aimed at the position of the baby, and the beam is tilted to bring the bottle to the baby. The weight of the baby bottle is counter balanced by counter weight on the beam. Such a device must be used on a flat horizontal stationary surface. Otherwise the support structure for the bottle will move with respect to the position of the baby. The counterbalance is based on the quantity of liquid in the body. As the bottle becomes lighter, it tends to move upwards owing to the effect of the counterweight. This prevents complete feeding of the baby, and exerts undue upward pressure on the baby's mouth. In addition, the device disclosed by Craig provides no means for "tracking" movement of the baby in lateral and vertical directions. It provides no means that would allow feeding of the baby in anything but a flat, stationary surface. The nursing bottle holding device disclosed by Craig therefore cannot be used in a vehicle, or any like situation where motion of the baby extant.

U.S. Pat. No. 3,184,193 to Melvin discloses a bottle support device attached to an infant seat. The bottle is clamped using a sleeve locking arrangement to a four-wire element or a single arm element, which supports the bottle in an inclined position to allow feeding of the baby. Location and angle of the bottle are fixed by the position of the bottle holding structure. Melvin discloses a nursing bottle holding device for use in inclined seats. It comprises a sleeve-clamping device, which holds the bottle. A support structure made from four wires or a single support rests on one side of the inclined infant seat. Since the position and the inclination of the bottle are fixed, the baby must be brought to the bottle to ensure feeding. Any movement of the baby will result in undue pressure on the baby's mouth. Therefore, the infant seat fitted with feeding device, as disclosed by the patent, cannot be subjected to vehicular motion. Inasmuch as the patented device provides for the bottle to be in the inclined position, liquid will likely spill from the bottle. Moreover, the bottle does not "track" movement of the baby in lateral and vertical directions, and is not well suited for use in a vehicle or like situation where motion of the baby is extant.

U.S. Pat. No. 3,298,649 to Paglee discloses a nursing bottle holding device attached to an infant seat. The bottle is clamped using a wire frame attached to the top of the infant seat. The wire frame can be moved up and down by traversing the wire frame structure on a notched vertical wire element attached to back of the infant seat. Notches in the vertical wire determine the set positions of the feeding device. The patent discloses a nursing bottle holding device for use with inclined seats comprising a wire frame structure attached to the top of an infant seat. The position of the wire frame structure is selected based on notch positions on a vertical bar. Vertical position of the bottle is thus adjustable stepwise. The inserted position of the bottle in the wire frame establishes the position of the bottle. A baby must be positioned to reach the bottle. Any motion of the baby, such has tilting of the baby's head, results in excessive pressure on the baby's mouth. Since the bottle is always in an inclined position, its liquid contents are likely to be spilled therefrom. The bottle does not "track" movement of the baby in lateral and vertical directions.

U.S. Pat. No. 4,014,505 to Dowd discloses a nursing bottle support, which is pivotally connected by a pair of hemispherical elements to a slotted convex curved base. The bottle can be located in any of the slotted positions and can face the baby at any desired angular location. Further, the inclination of the bottle can be controlled to assure proper feeding. The patent discloses a rectangular nursing bottle holding device, which is held by hemispherical pivoting elements, so that the location and the angular position of the bottle can be adjusted along a slotted curved support bar. No discussion is present in the patent concerning a method or means for attaching the slotted curved base to an infant seat or crib. The bottle is rigidly attached to the curved bar, so that movement of the baby tends to result in excessive mouth pressure. Since the bottle is always presented at an inclined angle, liquid therewithin leaks out. A baby must be positioned at a preselected location with respect to the curved base, in order for the device to feed the baby correctly. The bottle does not "track" movement of the baby in lateral and vertical directions. It therefore cannot be used in a vehicle or like situation where motion of the baby is extant.

U.S. Pat. No. 4,062,510 to Brochu discloses a nursing bottle holder, which holds the bottle between two opposing crib bars. Several straps are used to hold the bottle in place. The holder also holds a disc, which carries the nipple so that the angular orientation of the bottle can be set. The patent discloses a stationary nursing bottle holding device adapted to be attached to opposing bars of a crib. Several straps of the bottle hold the bottle in place. A disc having a central hole supports the nipple and sets the angle of the bottle. The bottle is rigidly attached to the crib bars, with the result that any movement of the baby triggers excessive mouth pressure. Since the bottle is always presented at an inclined angle, its liquid contents can leak out. The baby must be positioned at a specified location with respect to the fixed bottle in order for the device to feed the baby correctly. The bottle does not "track" movement of the baby in lateral and vertical directions, and therefore cannot be used in a vehicle or like situation where motion of the baby is extant.

U.S. Pat. No. 4,301,934 to Forestal discloses a nursing bottle device for infants. A fixed nursing bottle is held away from the baby in the inverted position while a flexible tube connects the bottle to the nipple. A baby needs only to access the nipple and nurse without supporting the bottle. The patent discloses a stationary fixed nursing bottle, which is attached to a flexible tube and is connected to a nipple. No disclosure is contained therein concerning a nursing bottle holding device. The nipple is attached to a flexible tube, and inserted in the baby's mouth. Due to the lightness of the flexible tube, some tracking is permitted. However, if the baby releases the nipple, it becomes inaccessible. The baby cannot find the nipple, and it is not presented to the baby. Moreover, the open nipple tends to cause liquid spillage, since the bottle is in a vertical position.

U.S. Pat. No. 4,309,008 to Sirks discloses a baby bottle holder device having a back plate, a front plate with a pocket, and a leaf member which connects the back and front frame to form an easel. Elastic straps hold the front and back plates and the bottle, setting the bottle angle. The sturdy frame holds the bottle and presents the angled bottle to the baby for feeding. The position and the angle of the bottle must be adjusted to locate it proximate the baby. The patent discloses a stationary nursing bottle-holding device, which is attached to opposing bars of a crib. Several straps are used to hold the bottle in place. A disc having a central hole supports the nipple and sets the angle of the bottle. The bottle is rigidly attached to the crib bars. Movement of the baby tends to result in excessive mouth pressure. Since the bottle is presented at an inclined angle, its liquid contents can leak out. The baby must be positioned at a specified location with respect to the fixed bottle in order for the device to feed the baby correctly. The bottle does not track the baby and therefore cannot be used in a vehicle or situation where motion of the baby is involved.

U.S. Pat. No. 4,630,793 to Hunter discloses a baby bottle belt, which holds the bottle in a biasable flexible belt member. The flexible belt member is, in turn, attached to stroller, child seat or a high chair. When the nursing bottle is the non-use position, the bottle is kept in a horizontal plane, with the nipple facing away from the child. To place the bottle in use, it is pulled up. This operation brings the bottle towards the baby, so that the nipple faces the baby. Such rotation is accomplished by the flexible belts, which support the bottle. The patent discloses a flexible belt-supporting device for nursing bottles. On one end the flexible belts are attached to the arms of a high chair, stroller or child seat. On the other ends, the flexible belts are attached to the bottle holder. The bottle can be moved from the horizontal non-use position to the feed position by pulling up on the bottle, creating an arc, which flexes the belts. Such operation brings the feeding end of the bottle to a specific location in space, at which location the baby's mouth must be present. This is accomplished by properly selecting a strapping location for the flexible belts. The bottle does not "track" movement of the baby in a lateral direction, and therefore cannot be readily used in a vehicle or like situation where lateral motion of the baby is extant.

U.S. Pat. No. 4,994,418 to Wallace discloses a lightweight pliable soft baby bottle having an impervious liner, which carries the feeding liquid. A conventional nipple is attached to the bottle. The flexible bottle is attached by straps to a baby's carriage, infant seat or the like, and can be bumped by the baby without injury. The patent discloses a soft flexible nursing bottle made from foam material having an impervious lining which carries the feed liquid. The bottle uses a standard nipple. Attachment of the flexible bottle to a baby carriage is accomplished, using straps. The bottle can be bumped by the baby without causing injury. With such an arrangement, the bottle is located at a fixed location, and the baby must position itself to reach the bottle. Inasmuch as the flexible foam member also has an impervious inner surface, the leak tight plastic bag therewithin does not collapse, with the result that the bottle must be angled to feed the baby. Thus, the bottle holding mechanism disclosed by the patent does not "track" movement of the baby in a lateral or vertical direction, and is unsuitable for use in a vehicle where such lateral and vertical movement of the baby or the baby's seat is likely to occur.

U.S. Pat. No. 4,953,816 to Wilkinson discloses a contoured flexible foam pad nursing bottle holder, which carries the nursing bottle in a yoke cradle and retains it by friction. The pad is positioned on the infant's chest and is attached by VELCRO to the seat belt, shoulder belt or other restraining devices of the car seat. The patent discloses a stationary nursing bottle-holding device for use with a car seat. The bottle holding device is essentially a thick contoured foam pad, which is attached to restraining devices such as seat belts, shoulder belts or other restraining devices of the car seat by VELCRO". The bottle does not appear to be angled, and remains at all times inserted within the mouth of the baby. If the baby wants to discontinue feeding, it is not clear how the baby can let go of the bottle. Since the bottle is held by friction in the pad, any movement of the baby due to the slackness of the seat or shoulder belts will release the feeding nipple, causing its liquid contents to drip over the baby. The bottle does not "track" movement of the baby in lateral and vertical directions. It cannot be used in a vehicle or like situation where motion of the baby is extant.

U.S. Pat. No. 5,037,046 to Mingledorff, Jr. discloses an adjustable baby nursing bottle holder, which holds the bottle in a tapered cylindrical holder with the nipple end held in the smaller diameter of the tapered cylinder. The tapered cylinder is adjustably positioned using two vertical legs of support members that are attached to two horizontal support feet using two universally adjustable ratchet joints. The bottle support location can thus be changed readily by the ratchet hinge action between the horizontal support feet and vertical attachment bars. The attachment of horizontal feet to a crib or a car seat determines the final position of the bottle. The patent discloses a stationary nursing bottle-holding device, which is attached to a car seat or a crib using rigid vertical members, which are attached to horizontal support feet with ratcheted joints. With this arrangement, the bottle can be swung back and forth by rotation of the ratcheted joints. The attachment location of the horizontal support feet determines the final position of the nursing bottle. Adjustment of the bottle is required for feeding, to assure its close proximity to the baby's mouth. Slight motion of the baby due to motion of a vehicle, for example, produces undue pressures on the baby's mouth. The angularity of the bottle is determined by the location of the horizontal support, and is fixed. Since the bottle is always presented at an inclined angle, its liquid contents can leak out. The bottle does not "track" movement of the baby in lateral and vertical directions, and therefore cannot be used in a vehicle or like situation where motion of the baby is extant.

U.S. Pat. No. 5,092,549 to Beech discloses an infant bottle holder attachment device for infant support, which holds the bottle in a baby seat. The bottle is attached to a horizontal bar, which is connected pivotally to two vertical bars, whose lengths can be adjusted. Two of the four pivotal joints are lockable to create a rigid frame. This device holds the angled nursing bottle in a car seat, rigidly locating the bottle at the baby's mouth level. The patent discloses an adjustable stationary nursing bottle-holding device, which is attached to a baby seat. The attachment system includes a central bar, which carries the bottle and is attached to two vertical bars having adjustable lengths using four pivoted joints. In order to create a rigid structure, two of the pivotal joints are lockable. This arrangement presents a rigid angled bottle to the baby; any motion of the baby or the car seat results in excessive pressure applied to the baby's mouth. Inasmuch as the angled nursing bottle is always presented to the baby, its liquid contents will leak or drip. The bottle does not "track" movement of the baby in lateral and vertical directions, and therefore cannot be used in a vehicle or like situation where motion of the baby is extant.

U.S. Pat. No. 5,129,610 to Campbell discloses a gimbaled adjustable holder for a nursing bottle, which holds the bottle between two sets of gimbals, one outer and one inner, and is supported by two bars of adjustable length. This allows proper positioning of the height of the bottle fixed to the two sets of gimbals. The gimbals allow tilt of the bottle, equivalent to tilting of the head of the baby up to down or left to right, without changing the height of the bottle. Feeding can be accomplished with ease, since the bottle is fully supported and has complete flexibility of movement, without applying any pressure to baby's mouth. The bottle holder can be attached to a car seat, flat bed or crib or child seat. The patent discloses a dual gimbals mounted bottle whose height can be adjusted. The gimbals mount allows free rotation of the bottle without bottle height change and apply no pressure to the baby. This device is said to be suitable for vehicular applications. However, its feeding nipple remains constantly inserted in the baby's mouth; no means are provided for nipple release by the baby. If the baby manages to move away, and release the nipple, the angled bottle will spill substantially all of its liquid contents. The bottle does not "track" movement of the baby in a lateral direction, and therefore cannot be readily used in a vehicle or like situation where lateral motion of the baby is extant.

U.S. Pat. No. 5,135,189 to Ghazizadeh discloses a baby bottle holder, which fits on a baby seat. The bottle is gripped using flexible fingers, and is attached to a flexible arm. The flexible arm is attached to a clamp through a rotary stem. The clamp holds the nursing bottle holding device on the baby seat. Both the rotating stem and the flexible arm locate the bottle near the baby's mouth. The patent discloses an adjustable stationary nursing bottle-holding device, which is attached to a baby seat. The adjustment of the nursing bottle is based on the clamping location on the baby seat, the rotary stem adjustment, the positioning of the flexible arm and final location of the bottle in the gripper. Once the bottle is attached, it is rigid and allows the baby to feed, providing proper inclination for the bottle. The ability of this device to accommodate small movements of the baby without applying undue pressures to a baby's mouth depends on the rigidity of the flexible elements. If, when attached, it is not rigid, small vibrations can sag the flexible arm, displacing the bottle from the baby. The bottle does not "track" movement of the baby in lateral and vertical directions and therefore cannot be used in a vehicle or like situation where motion of the baby is extant.

U.S. Pat. No. 5,184,796 to Maher discloses a baby bottle holder, which uses an inflatable support system strapped to the baby. The location of the bottle is based on the position of the straps and the degree of inflation of the bag. Inflation of the bag elevates the angle of the bottle by as much as 45 degrees, so that feeding is possible. The patent discloses an adjustable stationary nursing bottle-holding device adapted for use with an inflatable support system. The system is strapped to the baby. These adjustments locate the nursing end of the bottle near the baby's mouth. Pressure is required to elevate the bottle, creating a rigid bottle holding fixture. Movement of the baby tends to apply large pressures on the baby's mouth. Rejection of the bottle is not readily accomplished by the baby. Once rejected, the inclined bottle will leak, spilling substantially its entire contents near or on the baby. Decreasing pressure to accommodate motion and reduce nipple force against the baby's mouth causes the bottle to inadvertently break loose and "fly away" when the vehicle turns. With this arrangement, the bottle holding mechanism disclosed by the '796 patent does not "track" movement of the baby in lateral and vertical directions, and therefore cannot be reliably used in a vehicle or like situation where motion of the baby is extant.

U.S. Pat. No. 5,489,075 to Ible discloses a baby bottle holder and feeder, which is clamped to the bottle. The clamp is attached to a flexible element, which in turn, terminates with another clamp, holding the device on a baby car seat. The location of the bottle with respect to the baby's mouth and the angle of the bottle are adjusted, using the flexible element. The patent discloses an adjustable stationary nursing bottle-holding device, which uses two clamps. A first of the clamps holds the bottle and the second holds the device against the car seat. A flexible element between the two clamps adjusts the location and the angle of the bottle. The bottle holder and feeder arrangement disclosed by the patent is operative to push the bottle against the baby. Owing to the rigidity of the flexible element, which is relatively stiff, small movements of the baby apply significant pressures against the baby's mouth. If the flexible element were compliant, small motions might be accommodated, but the location of the bottle would droop, displacing the weight of the bottle onto the baby's face. This interrelationship among elements of the Ible device cause it to be unsuitable for vehicular applications, such as those involving traverse of rough roads or the acceleration-deceleration and numerous turns encountered with suburban and city driving. Since the bottle is always inclined at an angle, the liquid from the bottle will spill over the baby's face and clothing. The bottle does not "track" movement of the baby in lateral and vertical directions, and therefore cannot be used in a vehicle or like situation where motion of the baby is extant.

U.S. Pat. No. 5,603,479 to Kristy discloses a baby bottle holder having a frangible joint. The holder is adapted for use in an automobile. It clamps the bottle on one side and is attached either to a car seat or an automobile element. The two clamps are connected with a frangible flexible element, which fractures when the automobile is involved in an accident. Uncontrolled projectile behavior of the fractured pieces is prevented by use of tethers. The location of the bottle with respect to the baby's mouth and the angle of the bottle are adjusted using the flexible element. The patent discloses an adjustable stationary nursing bottle-holding device, which uses two clamps, one to hold the bottle and the other to hold the device against the car seat or an automobile element. A frangible flexible element between the two clamps is used to adjust the location and the angle of the bottle. The frangible element is designed to fracture when the automobile is involved in an accident. It is provided with a frangible joint, such as a pre-cut tube, to facilitate fracture in the event of an automobile accident. A tether is used to prevent the fractured pieces from flying uncontrollably within the automobile. When the car is involved in an accident, the baby and the bottle move forward as the vehicle rapidly decelerates. Since the baby is restrained by the car seat, the unrestrained bottle moves forward. If it breaks, portions of the bottle may rebound off the backside of the front seat and injure the baby.

U.S. Pat. No. 5,727,842 to O'Neil discloses a device for attaching a baby bottle to a car seat. If the car seat does not have a crash bar, a link is attached by clamps to the back of the seat. The bottle is centrally attached to the sling by holding the neck of the bottle with a rope. When the bottle is not in use, the bottle stays vertical without spilling the liquid contained therein. The infant raises the sling to feed. If the car seat has a crash bar, a polymeric segmented spine is used to carry the bottle using tapes. When the bottle is not in use it remains in a vertical position. The infant pulls the bottle, bending the spine to access the bottle. O'Neil discloses a movable nursing bottle holding device, which is attached to a car seat with or without a crash bar. When no crash bar is available, a sling is attached by clamps to the back of the seat and the nursing bottle is centrally attached by ropes. If crash bar is present, a segmented spine made from polymeric material is used to carry the bottle. In either case, the infant pulls the bottle from the vertical position. The patent provides no mechanism for adjusting the position of the bottle or the angle of the bottle with respect to the baby's location. In addition, with use of the patented system, slight movement of the baby can result in large pressures on the baby's mouth. The bottle does not "track" movement of the baby in lateral and vertical directions, and might apply harmful pressures against a baby's mouth during vibrations caused by movement of the vehicle over rocky roads or around sharp corners.

U.S. Pat. No. 5,820,084 to Trumbauer et al. discloses a baby bottle-supporting bib, which uses a foam support with a trough for receiving the bottle and is attached to a bib, which is strapped to the baby. The bottle is strapped to the foam support and maintains the required angular tilt of the bottle. This device can be used to feed the baby when the baby is lying on the crib or is seated on an inclined baby seat. The patent discloses a fixed stationary nursing bottle-holding device, which attaches the bottle in the inclined position on a foam with a trough. Such fixed angular positioning places the bottle in a very rigid position with respect to the baby. Although the bottle moves with the baby freely, the baby cannot remove the bottle when feeding is complete. In addition, the inclined bottle keeps spilling the liquid into the baby's mouth, causing the baby to choke or gag on the excessive liquid thereby delivered.

U.S. Pat. No. 5,823,486 to Smith et al. discloses a universal flexible arm, which can be attached to a car seat, crib, stroller or the like. The other end of the flexible arm holds the nursing bottle. The adjustable nature of the universal flexible arm includes functionality for positioning of the height and angle of the bottle at any selected location. Adjustment is accomplished by setting the threaded devices of the universal flexible arm. A pringle locks the nursing bottle, while a jaw fixture locks the universal flexible arm to the car seat. The patent discloses an adjustable stationary nursing bottle-holding device, which is rigidly attached to a car seat. Both the universal arm and the bottle are mechanically locked. This presents to the baby, a bottle that is essentially non-compliant. Any motion of the baby caused by vehicle vibrations produced during rapid acceleration or deceleration, or turning sharp corners, can apply undue pressure against baby's mouth. In addition, the inclined angle of the bottle causes its liquid contents to leak if the baby rejects the nipple. The bottle's holding mechanism does not "track" movement of the baby in vertical and lateral directions, and therefore cannot be used in a vehicle or like situation where motion of the baby is extant.

U.S. Pat. No. 5,927,661 to Tinsley et al discloses a bottle suspension apparatus, which is secured to the handle of a baby car seat and presents an angled nursing bottle to the baby. The bottle suspension system consists of sewn elastic members, which grip the bottle and two non-elastic members, which attach the bottle to the baby car seat with VELCRO. The attachment system is sufficiently flexible to hold the baby bottle close to the baby. It tolerates some movement of the baby and can be removed or displaced by the baby when the baby chooses not to nurse. The patent discloses an adjustable stationary-nursing bottle holding device, which is attached to the car seat handle and includes VELCRO attachment, elastic bottle grip and non-elastic support members. The angular tilt of the bottle is preserved as the baby feeds, since the liquid moves to the lowest point due to the low stiffness of the elastic bottle holder. Since the bottle is always inclined, it will spill its liquid contents if the baby rejects the nipple. The low stiffness of the bottle retaining structure can oscillate at resonant frequencies in a moving vehicle. Such oscillation is likely to occur suddenly when incoming vibrations match the resonant characteristics of the bottle holding mechanism's low stiffness.

U.S. Pat. No. 5,979,843 to Beck discloses a baby bottle holder and feeding device. The device has a rolling means, the operation of which is triggered when the baby disengages the bottle nipple. A weight attached to the bottle causes the bottle to roll off the chest of the infant when the nipple is released. Angular presentation of the nursing bottle is provided by the bottle support structure. This device facilitates feeding of the baby in a crib or horizontal position, where the bottle and the grip can be held using 'jiffy grip'. The patent discloses a stationary nursing bottle-holding device, which rests on the chest of a baby. A weight attached to the bottle is designed to roll the bottle off the baby's chest when the nipple is released. The unstable nature of the bottle holder's weight distribution causes the bottle to roll away from the baby. Rollaway motion of the bottle is triggered if the baby moves suddenly or by other vibrations such as those extant in a moving vehicle. This device is unsuitable for use with moving vehicular applications, in which vibrations are produced by rough roads or sharp corners. It does not "track" movement of the baby in lateral and vertical directions. When the bottle rolls over, it still remains in an angular orientation, causing its liquid contents to spill.

U.S. Pat. No. 6,213,547 to Bowe et al. discloses an adjustable baby bottle holder, which presents an angled nursing bottle to the baby in a car seat. The position of the bottle is primarily adjustable by the baby caretaker, and the baby has limited control on the position and presentation of the bottle. The bottle is hung from a rigid horizontal rod, which is attached to a vertical inverted U shaped frame fixed to the car seat. The childcare provider controls the position of attachment of the horizontal rigid rod, and it establishes the location of the bottle with respect to the baby. The bottle is hung from the horizontal rod using a pivoted arrangement, so that the baby can slide the bottle on the horizontal rod or tilt it to change the angular presentation of the nursing bottle. The patent discloses an adjustable stationary nursing bottle holding device, which is attached to a car seat and provides primary positioning control of the nursing bottle by the childcare provider. The baby has limited control over the angle of presentation of the bottle, as well as its lateral location. The nursing bottle has limited capability for tracking movement of the baby. Since the bottle is always presented at an angle, it can spill its liquid contents if the baby rejects the nipple. The pressure exerted on the baby's mouth during sliding of the bottle structure on the horizontal bar is significant, owing to frictional forces extant when the bottle is full of liquid, and heavy.

There remains a need in the art for providing a nursing bottle holding means, which tracks a baby's, movement and allows feeding without applying undue pressure against the baby's mouth. In addition, there is needed a nursing bottle holding means wherein a bottle nipple is easily rejected and re-accessed by the baby, without consequent spillage of the bottle's liquid contents.

SUMMARY OF THE INVENTION

The present invention provides a flexible, resilient hands-free infant feeding system for presenting a spill-proof nursing bottle attached either directly to the baby to a fixed support device that is fixed in relation to the baby so that the resilient flexible support system can track the baby's movement without applying excessive pressure to the baby's mouth. The bottle supporting and holding unit is generally a trapezoidal member fabricated from sponge like resilient and flexible material and is held against the chest of a baby using multiple strap elements fabricated from elastic or non-elastic material. The resiliency, flexibility and "trackability" of the nursing bottle is accomplished by the flexibility of the sponge like trapezoidal member and the slackness in the strap elements. The friction between the flexible sponge like trapezoidal member and the baby's chest assures the location and the angle of presentation of the drip proof bottle fitted with collapsible leak tight plastic bag.

The bottle preferably comprises a plastic bag adapted to collapse as the bottle fluid is depleted. Feeding is readily accomplished in virtually any orientation without dripping. The straps loop around the baby or carrying seat so that the bottle is loosely positioned on the chest of the baby. At least one of the straps can be looped around the baby's shoulders. Both straps have one end anchored to the bottle supporting and holding unit using releasable attachments. The other ends of the straps are adjustably anchored to the other end of the bottle supporting and holding unit using hook and loop fasteners such as Velcro® fasteners, or the like. A bottle of circular cross section is disposed in an elliptical cavity with elastic compliance, so as to allow limited motion of the bottle. The straps provide limited compliance and freedom of movement so that, within a movement range of approximately 2 to 6 inches the bottle remains reachable by the baby. That is to say, the compliance and holding is such that the bottle tracking is facilitated in each of the lateral and vertical directions, so control between the baby's mouth and the nipple is maintained. Such "tracking action" advantageously enables the bottle to be available for nursing at all times, without applying excessive pressure to the baby's mouth. Importantly, the baby can stop nursing at any time, without having to reject the nipple. Liquid contained by the bottle is not spilled, since the collapsed plastic element therein promotes retention of the liquid unless the baby is nursing. As used herein the term "compliance" means a structure having low load, as of the order of about 10 to 20 grams, so as to minimize pressure applied against the baby's mouth, and limited displacement, typically traversing a displacement range of about 0.5 to 6 inches.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
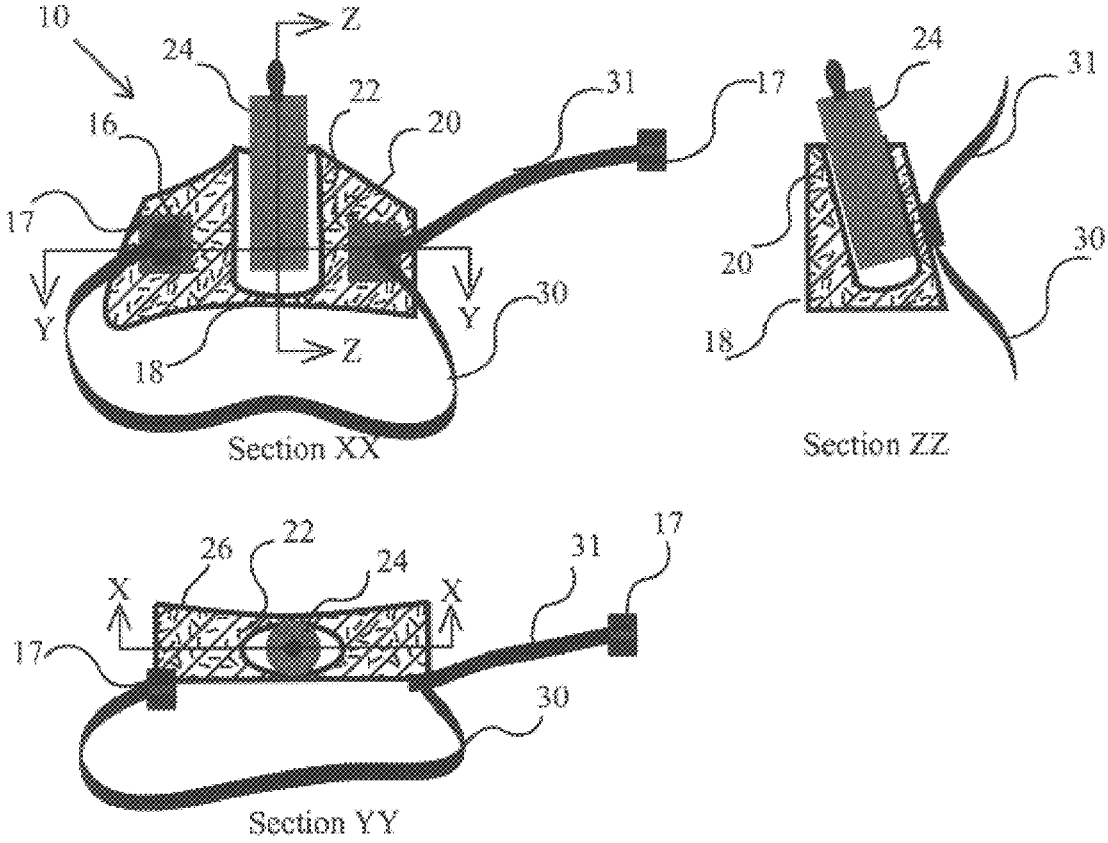
FIG. 1 is a perspective view showing a flexible, resilient nursing bottle supporting system in accordance with the present invention.

Referring to FIGS. 1–4 of the drawings, there is shown, generally at 10, a bottle supporting and holding unit in accordance with the present invention. Generally stated, the unit 10 comprises a soft bottle supporting structure 12 composed of sponge rubber or the like. Structure 12 is generally trapezoidal in a vertical plane at 18–20. A plurality of plane surfaces 16 of the trapezoidal bottle supporting structure 12 extend upwardly from a base portion 18 of the unit to top portions 16 and 20, which is concavely shaped to produce an elongated channel 22. The size and length of the channel 22 is especially designed to permit a baby bottle 24 to be placed and held securely therein by the friction between the bottle 24 and the elliptical cavity 22. The elliptical character of the cavity is established automatically during implementation of the procedure employed to hold the trapezoidal element against the baby's chest. The straps pull the trapezoidal flexible member, thus elongating the hole wherein the baby bottle is held, resulting in an elliptical cavity. Preferably, the base portion 18 has a bowed configuration 26, which is adapted to be placed and held comfortably against the chest of an infant that is using the unit 10. Presentation of the bottle to the baby is determined by the wedge like character of the trapezoidal element, as shown by the side view along ZZ of FIG. 1. The trapezoidal element is shaped like a wedge, as shown in FIG. 1, thereby presenting the bottle to the baby at an angle. In one embodiment, the angle is adjusted by positioning the trapezoidal element on the baby's chest, to locate the element slightly nearer or farther from the baby's head. In another embodiment, spacers are inserted between the baby and the bowed bottom region 18 to increase the angle. In yet another embodiment, an air inflatable device similar to a balloon is used to adjust the angle at which the bottle is presented to the baby.

The trapezoidal member 12 is exceedingly safe, being composed of a soft, sponge like material. It holds bottle 24 in elliptical cavity 22. The elliptical cavity 22 is created by the stretch applied to the flexible resilient member by the straps at 30 and 31, which hold the trapezoidal member on the baby's chest. The bottle is therefore presented to the baby at the required angle, as determined by the shape of the trapezoidal member. Compliance provided by the sponge like member, together with the rocking capability of a cylindrical bottle in an elliptical cavity, allows small movement of the bottle with respect to the baby's mouth without application of undue pressure thereagainst. Disposition of the bottle within the elliptical cavity 22 is shown at 24 by FIG. 1.

Two non-elastic straps 30 and 31 are permanently anchored to the trapezoidal element 12 on one end 20 as shown in FIG. 1. The length of the straps is adjustable and sliding the anchoring for fastening means 17 provides this adjustment. The free ends of the straps, carrying the fastening device, are anchored back on the trapezoidal element 12 at locations 16 as shown in FIG. 1. The fastening means may be a buckle or VELCRO strip, or other suitable fastening means.

Unit 10 is placed in service by securing strap 30 around an infant's torso. The strap 30 then continues around the carrying seat or stationary seat, as the case may be. Strap 31 is then secured around the shoulder of the infant. These straps, functioning together, collectively hold the trapezoidal element 12, and accompanying nursing bottle 24, on the chest of the baby. If the straps are tight, the compliance of the nursing bottle is provided primarily by the elliptical cavity 22 and the resiliency of the flexible trapezoidal element. When the straps are fastened with a lesser amount of slack, the trapezoidal element can correspondingly slide over a correspondingly larger portion baby's chest and therefore, the compliance is increased. In either case, the baby or the bottle can move during feeding by 2 to 6 centimeters. During this movement minimal force is applied against the baby's mouth. Such force typically comprises a load ranging from about 20 to 200 grams (weight). The baby can easily release and re-access the bottle, which remains within reach and constantly available to the baby owing to the compliance and tracking ability of the nursing bottle holding device. A collapsible leak tight plastic bag disposed within the nursing bottle is operative to prevent spillage of the bottle's liquid contents on the baby, despite continued release and re-access during nursing.

Alternatively, the straps 30 and 31 can be adjusted to go around and secure the bottle holding and supporting unit to a baby seat or car seat. Since the position of the baby is fixed with respect to the car seat or the baby seat, the nursing bottle-holding unit can be readily secured to the infant's chest, providing proper compliance and tracking ability.

Figure 2:
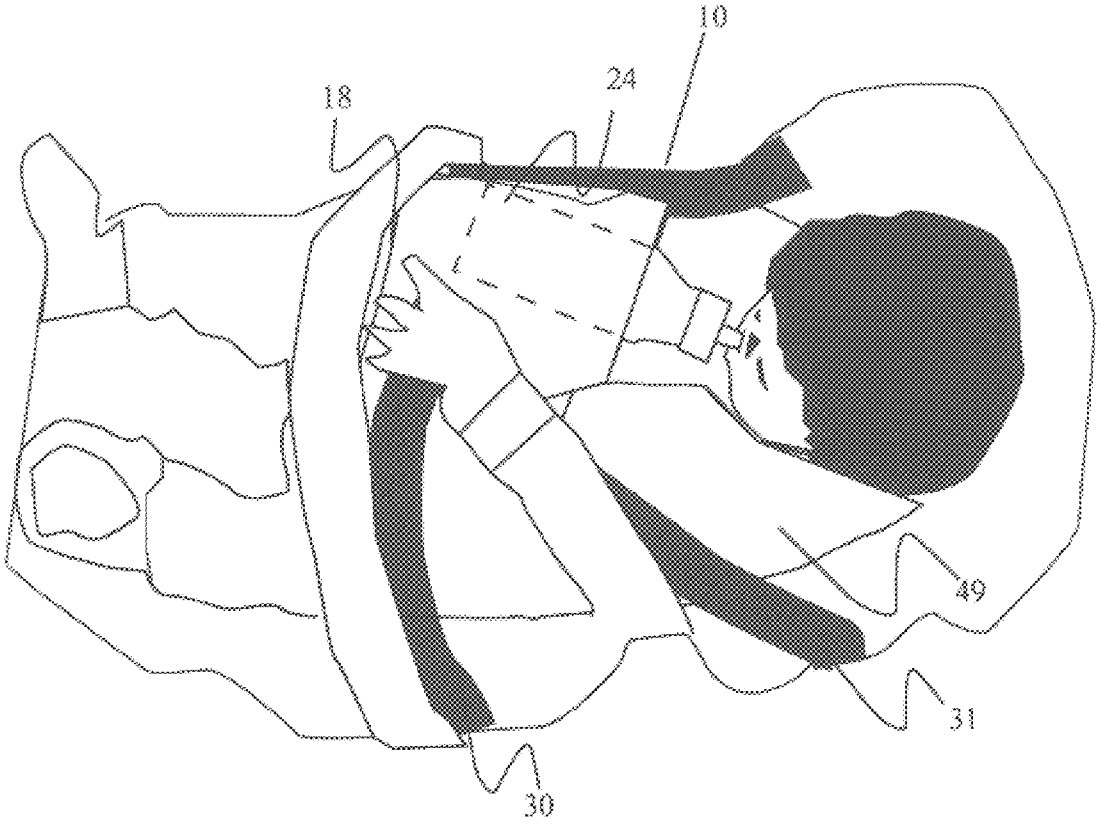
FIG. 2 is a perspective view depicting use of the nursing bottle holding system of the subject invention when the baby is placed in a carrying seat.
Figure 3:
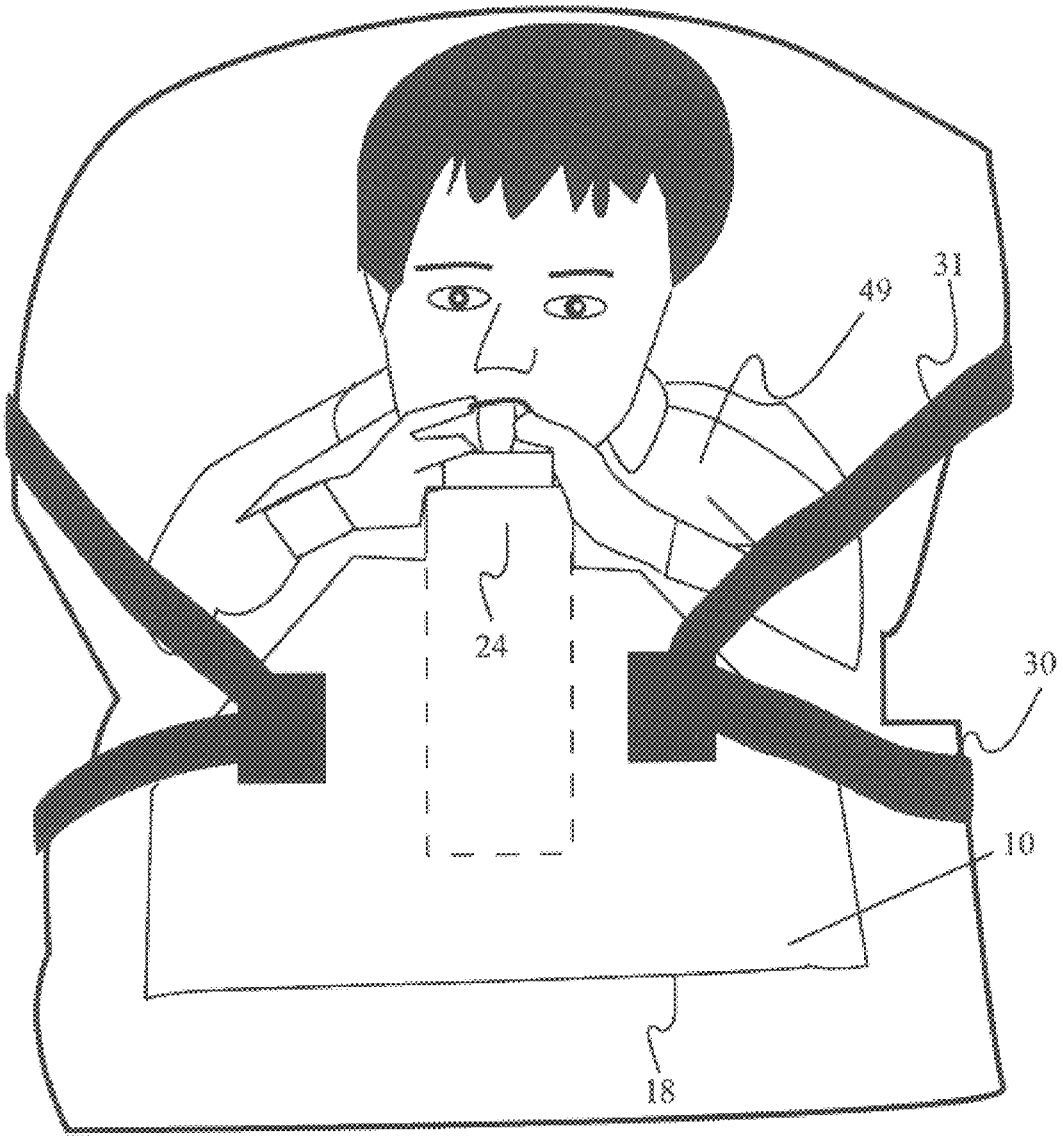
FIG. 3 is a perspective view depicting use of the nursing bottle holding system of the subject invention when the baby is placed in a stationary baby seat.

In FIGS. 2 and 3 there is shown the use of the nursing bottle holder in connection with a baby car seat or a baby seat. Strap 30 is adapted to be placed around the torso of an infant, thereby holding the flexible bottle-holding unit against the infant's chest. The infant 49, bottle 24, bottom of the trapezoidal element 18 and the bottle holding system 10 are shown by FIGS. 2 and 3. Preferably, strap 30 is further adapted to have sufficient length to permit it to extend around the infant's carrying seat. Fastening of the free end of the strap, thus extended, to the unit 10 reliably secures the it and bottle 24 in place. The extended end of the strap can alternatively be attached to a structural connecting point on the side of the seat. The nursing bottle holding system securely holds a baby bottle in position so that the nipple end of the bottle is proximate the mouth of the infant. The bottle can be moved, together with the baby, and the baby can reach the feeder bottle at any time due to the compliance of the elliptical cavity in the sponge like trapezoidal bottle holding structure, without application of excessive force against the infant's mouth. The bottle in this structure preferably comprises an internal leak tight plastic bag adapted to collapse as the bottle's fluid contents is depleted. With this embodiment, feeding of the infant is readily accomplished using a wide variety of angular positions. Spilling of liquid from the bottle is virtually eliminated even during jostling occasioned when the vehicle swerves or traverses rough roads. An even flow of fluid is supplied to feeding infants during travel or in stationary environments, without constant parental supervision. A parent or childcare attendant is thereby enabled to pursue domestic tasks in the near vicinity of the infant during the feeding process. A pacifier may be used in lieu of a bottle to calm an infant during travel in land vehicles.

Figure 4:
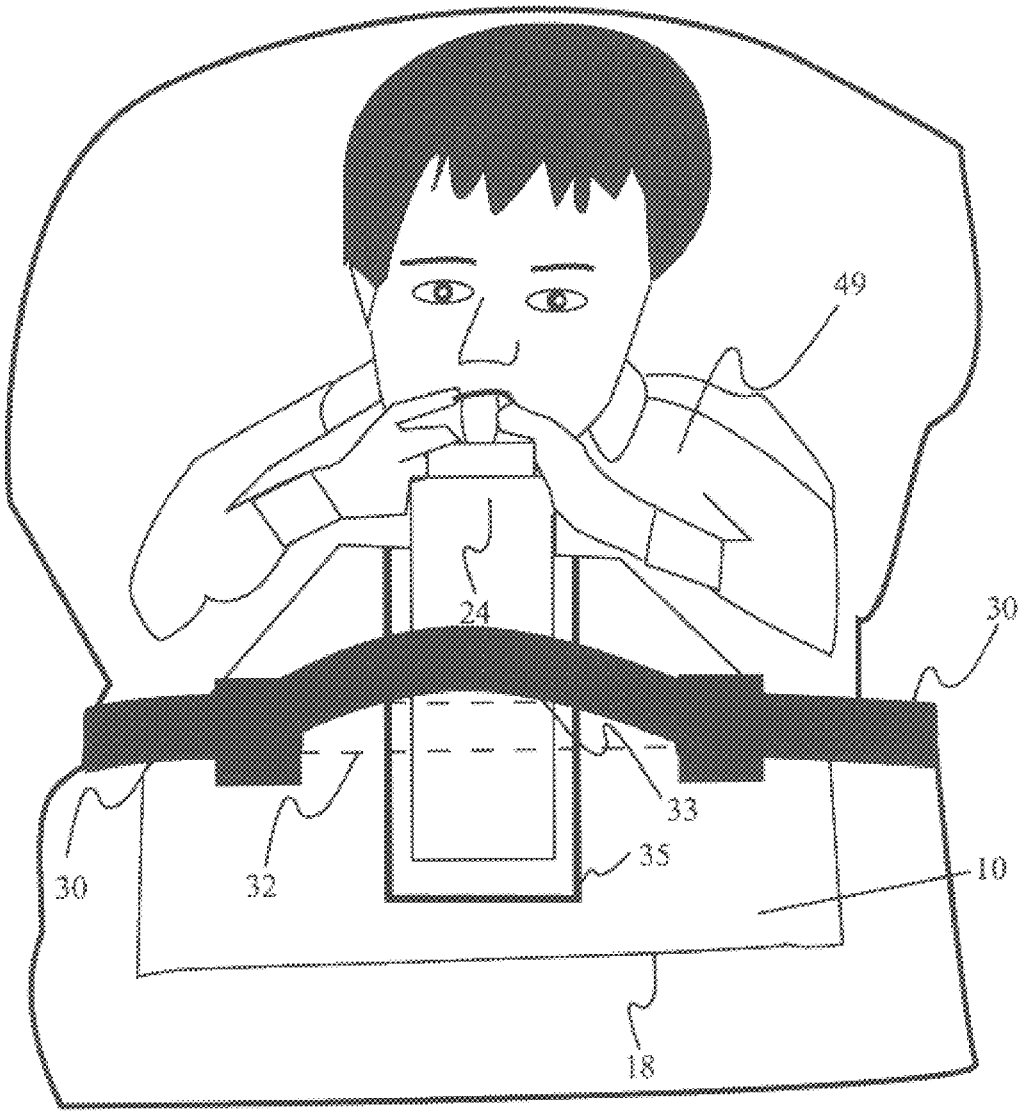
FIG. 4 is a perspective view depicting use of alternate embodiment of the nursing bottle holding system of the subject invention when the baby is placed in a stationary baby seat.

FIG. 4 depicts an alternate embodiment of the nursing bottle holding device. The nursing bottle 24 is held in a U shaped open channel 35 in a resilient compliant sponge-like material and the bottle is strapped around the torso of an infant using a belt 30 which is strapped over the bottle. The pulling action of the belt 30 widens the channel allowing the bottle to move over short distances without applying excessive force to the baby's mouth as the bottle is moved by the baby. This strap 30 is attached to the carrying seat by suitable fastening means, such as a buckle, hook and loop fasteners by the tradename VELCRO or other fastening means. The strap 30, which is generally inelastic, and has an optionally elastic member 32, which loops below the bottle, preferably inside the trapezoidal sponge-like member. This elastic member provides compliance to the gripping action of the bottle. The bottle is strapped using a loop of belt 33, which is above the bottle and the tension in this belt is adjustable to provide adequate bottle support and compliance. The tracking ability is provided by the compliance of the sponge-like material, the slack provided by the strap element 30 and the width of the channel 35. Depending upon the friction between the sponge like member and the baby's chest and the loading applied by strap 30, the bottle holder is prevented from inadvertent displacement or sliding on the baby's chest caused by deceleration of the vehicle or movement of the baby's head.

As described above, the nursing bottle holding system uses a soft trapezoidal element especially adapted to carry a nursing bottle. This bottle preferably comprises a leak-tight plastic bag adapted to collapse as the bottle fluid is depleted. Feeding is readily accomplished in virtually any orientation without dripping. The straps 30 loop around the baby or carrying seat so that the bottle is loosely positioned on the chest of the baby. Strap 31 can be looped around the baby's shoulders. Both straps have one end 20 anchored permanently and the other end 16 adjustably anchored using releasable attachments 17 contained by the nursing bottle holding system 10, as shown by FIGS. 1–4. The bottle of circular cross section 24 is disposed in an elliptical cavity 22 with elastic compliance so as to allow limited motion of the bottle. The straps provide limited compliance and freedom of movement so that, within a movement range of approximately 2 to 6 centimeters the bottle remains reachable by the baby. That is to say, the compliance and holding features cooperate collectively to facilitate bottle tracking in each of the lateral and vertical directions, so control between the baby's mouth and the nipple is maintained. Such "tracking action" advantageously enables the bottle to be available for nursing at all times, without applying excessive pressure to the baby's mouth. Importantly, the baby can stop nursing at any time, without having to reject the nipple. Liquid contained by the bottle is not spilled, since the collapsed leak-tight plastic element therein promotes retention of the liquid unless the baby is nursing.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A detachable, flexible, tracking baby bottle holder system, comprising:

a. a trapezoidal, soft, flexible element for supporting a baby bottle within a bottle holding cavity;

b. strap means for attaching said flexible element with a baby bottle supported thereon against the chest of an infant;

c. strap load adjustment means for stretching said bottle holding cavity into an elliptically shaped cavity;

d. bottle inclination adjustment means for adjusting said flexible trapezoidal member to change angular inclination of said bottle and thereby bring its nipple within comfortable reach of said infant; and e. bottle tracking means operating in combination with said elliptical cavity and said flexible trapezoidal element to provide for controlled displacement of said bottle in directions corresponding with movement of said infant, for accommodating bottle motion during feeding, thereby minimizing application of transverse and vertical forces exerted by said nipple against the mouth of said infant.

2. A baby bottle holder system as recited by claim 1, wherein said trapezoidal flexible element is composed of an elastomeric foam material.

3. A baby bottle holder system as recited by claim 1, where the system has a baby bottle and said baby bottle is spill proof and contains liquid housed within collapsible leak-tight plastic bag.

4. A baby bottle holder system as recited by claim 1, wherein said bottle inclination adjustment means comprises a plurality of inserts disposed above said infant's chest.

5. A baby bottle holder system as recited by claim 1, wherein said inserts comprise inflation control means for controlling the inflation and deflation thereof.

6. A baby bottle holder system as recited by claim 1, wherein said strap means is adapted to encircle said infant's torso and shoulder to securely locate said flexible element against the infant's chest.

7. A baby bottle holder system as recited by claim 6, wherein said strap means comprises a plurality of straps, and said straps have adjustable lengths.

8. A baby bottle holder system as recited by claim 7, wherein said displacement of said bottle ranges from about 2 to 6 centimeters and said transverse and vertical forces range from about 20 to 200 gram weight loading.

9. A method for hands-free feeding of an infant, comprising the steps of: in moving vehicles using a trackable baby bottle holder comprising;

a. positioning a trapezoidal soft flexible element supporting a baby bottle within a bottle holding cavity near said infant's chest;

b. encircling said infant's torso and shoulder with strap means to securely locate said flexible element against the infant's chest;

c. applying tension to said strap means to stretch said bottle holding cavity into an elliptically shaped cavity;

d. adjusting inclination of said bottle by inflating and deflating a plurality of sections on said flexible member and e. controlling displacement of said bottle in directions corresponding with movement of said infant to accommodate bottle motion during feeding and thereby minimizing application of transverse and vertical forces exerted by said nipple against the mouth of said infant.

* * * * *